US009404212B2

(12) United States Patent
Nawrot et al.

(10) Patent No.: US 9,404,212 B2
(45) Date of Patent: Aug. 2, 2016

(54) EXHAUST AIR DRYER HAVING A FAN

(75) Inventors: Thomas Nawrot, Berlin (DE); Andreas Ziemann, Potsdam (DE)

(73) Assignee: BSH Hausgeräte GmbH, Munich (DE)

( * ) Notice: Subject to any disclaimer, the term of this patent is extended or adjusted under 35 U.S.C. 154(b) by 1326 days.

(21) Appl. No.: 12/812,254

(22) PCT Filed: Dec. 18, 2008

(86) PCT No.: PCT/EP2008/067874

§ 371 (c)(1),
(2), (4) Date: Jul. 9, 2010

(87) PCT Pub. No.: WO2009/089985

PCT Pub. Date: Jul. 23, 2009

(65) Prior Publication Data

US 2010/0281707 A1 Nov. 11, 2010

(30) Foreign Application Priority Data

Jan. 15, 2008 (DE) ..... 10 2008 004 459

(51) Int. Cl.

| | |
|---|---|
| ***D06F 58/20*** | (2006.01) |
| ***D06F 58/02*** | (2006.01) |
| ***D06F 58/28*** | (2006.01) |

(52) U.S. Cl.

CPC ..... *D06F 58/20* (2013.01); *D06F 58/02* (2013.01); *D06F 58/28* (2013.01); *D06F 2058/2864* (2013.01)

(58) Field of Classification Search

CPC ..... D06F 58/20; D06F 58/28; D06F 58/02; D06F 2058/2864

USPC ..... 34/72, 130, 132, 595, 604, 605, 606, 34/607, 134, 138, 140, 235

See application file for complete search history.

(56) References Cited

U.S. PATENT DOCUMENTS

| | | | | |
|---|---|---|---|---|
| 3,352,224 | A * | 11/1967 | Gillick | 454/105 |
| 4,519,145 | A * | 5/1985 | Mandel | 34/389 |
| 4,875,298 | A * | 10/1989 | Wright | 34/86 |
| 6,678,969 | B1 * | 1/2004 | Hong | 34/595 |
| 7,426,791 | B2 * | 9/2008 | Martin | 34/607 |
| 2003/0000104 | A1 | 1/2003 | Song et al. | |
| 2008/0163510 | A1 | 7/2008 | Dittmar et al. | |

FOREIGN PATENT DOCUMENTS

| | | | |
|---|---|---|---|
| DE | 3000865 | A1 | 7/1981 |
| DE | 19904993 | A1 | 8/2000 |
| DE | 4306217 | B4 | 4/2004 |
| EP | 1813712 | A1 | 8/2007 |

* cited by examiner

*Primary Examiner* — Jiping Lu
(74) *Attorney, Agent, or Firm* — Michael Tschupp; Andre Pallapies

(57) ABSTRACT

An exhaust air dryer having a housing that encloses an inner space, wherein the following structures are arranged in the inner space: a drying chamber for items to be dried; a supply air duct between a first supply air inlet and the drying chamber to supply air; a heater to heat the supply air in the supply air duct; a fan to guide heated supply air through the drying chamber; and an exhaust air duct arranged between the drying chamber and an exhaust air outlet on the housing to exhaust air. The fan is a dual-flow fan having a first flow path and a second flow path, wherein the first flow path is arranged in the exhaust air duct and the second flow path is arranged in the supply air duct.

20 Claims, 4 Drawing Sheets

EXHAUST AIR DRYER HAVING A FAN

BACKGROUND OF THE INVENTION

The invention relates to an exhaust air dryer having a housing enclosing an inner space, it being possible for a drying chamber for items to be dried, a supply air duct between a first supply air inlet and the drying chamber for supply air, a heater for heating the supply air in the supply air duct, a fan with which the heated supply air can be guided through the drying chamber, and an exhaust air duct between the drying chamber and an exhaust air outlet on the housing for exhaust air, to be arranged in the inner space.

Such an exhaust air dryer is disclosed in DE 30 00 865 A1.

In general, a washer dryer is designed and operated as an exhaust air drier or a condensing dryer. In order to absorb moisture, an exhaust air dryer generates warm process air which is blown through the washing to be dried and then removed from the washer dryer. In any case, for the removal when the exhaust air dryer is installed inside a building, a suitable exhaust air hose must be used, by which the moisture-laden process air is conveyed out of the building—whether directly or via a permanently installed exhaust air duct. A condensing dryer whose mode of operation is based on the condensation of the moisture from the laundry vaporized by means of warm process air, requires no exhaust air hose and facilitates energy recovery from the heated process air, for example by use of a heat pump.

In general however, in the case of an exhaust air dryer, after passing through a washing drum the moisture-laden air is conveyed out of the dryer, it not being possible for energy recovery to take place. An exhaust air dryer with heat recovery is nevertheless known from DE 30 00 865 A1. In this exhaust air dryer ambient air (for example at 20° C. and 60% relative humidity: so-called supply air) flowing along heat exchanger surfaces of an air-air heat exchanger is heated at that point during cooling of the warm process air coming from the drying chamber, which likewise passes through the heat exchanger. Dependent on the cooling capacity or heat exchange, condensate is produced and collected in a container (condensate trough) or pumped away.

In this known dryer a fan is used to convey the process air (supply air or exhaust air). In addition, known dryers generally have only one motor which drives both the rotatable drying chamber (washing drum) and the fan.

Finally, devices are known in dryers which are intended to influence the conduction of the process air. DE 43 06 217 B4 describes a program-controlled washer dryer in which the process air is guided by means of a fan in a closed process duct in which specially arranged closing devices are located. The closing devices are appropriately actuated dependent upon the operating state (heating phase, washing-drying phase, attainment of the maximum permissible temperature).

With an exhaust air dryer it is often desirable to be able to use the longest possible exhaust air line or longest possible exhaust air hose in order to have more flexibility with regard to the installation of the dryer where the exhaust air is not intended to be output to the inside of the installation room.

BRIEF SUMMARY OF THE INVENTION

An object of the present invention is therefore to provide an exhaust air dryer having higher energy efficiency, which can be driven by only one motor. This dryer should preferably allow a longer exhaust air line to be used and to utilize the waste heat which has accumulated in the dryer.

The subject matter of the invention is therefore an exhaust air dryer having a housing enclosing an inner space, it being possible for a drying chamber for items to be dried, a supply air duct between a first supply air inlet and the drying chamber for supply air, a heater for heating the supply air in the supply air duct, a fan with which the heated supply air can be guided through the drying chamber, and an exhaust air duct between the drying chamber and an exhaust air outlet on the housing for exhaust air, to be arranged in the inner space, and it being possible for the fan to be a dual-flow fan having a first flow path and a second flow path, and it being possible for the first flow path to be arranged in the exhaust air duct and the second flow path to be arranged in the supply air duct.

In this case the two flow paths are sealed off from each other, that is to say are isolated from each other in terms of flow.

According to the invention, air from the inner space of the exhaust air dryer which is heated by waste heat from various components of the exhaust air dryer, can be utilized for the drying process in the exhaust air dryer. Loss of useable heat from the exhaust air dryer can thus be prevented and the effectiveness of the drying process therefore increased. In a preferred embodiment of the invention the drying chamber is able to be rotated and in accordance with conventional practice designed as a drum and able to be driven by a motor, it being possible for the first supply air inlet to be arranged to draw in air from the vicinity of the motor. A thermally loaded component of the exhaust air dryer, in this case the motor, is thus provided with cooling by positioning the first supply air inlet in such a way that when air is drawn into the first supply air inlet an airflow is generated which flows over the loaded components, and surplus heat which has been absorbed by such air is carried away from the loaded components.

Also preferred is an embodiment of the inventive exhaust air dryer in which the motor is set up to drive both the drying chamber and the fan. Furthermore, the use of a single motor is thus possible for driving drying chamber and fan. In addition, the waste heat of the motor is utilized and therefore not only energy saving but also protection of the motor is achieved. Due to active cooling of the motor, the latter can be of a smaller design with regard to laminated core and winding. It is possible to use a relatively short, low-cost shaft journal at one end of the motor to drive the fan.

In all embodiments it is advantageous if the configuration of the inner space and of the ventilating paths in the vicinity of the motor and/or any other component facilitates effective removal of the waste heat from the motor or from the other component.

The throughput of the two flow paths in the dual-flow fan of the inventive exhaust air dryer can vary within a wide range. The first and the second flow path each has a throughput of 50 $m^3$ to 500 $m^3$.

The heater in the supply air duct for heating the supply air (process air) can preferably be an electrical heater (electrical resistance heater) or a gas heater. As the degree of drying of the items to be dried in the exhaust air dryer increases, the energy necessary for drying decreases and the heating is usefully regulated accordingly, that is to say with an increasing degree of drying its heating power is reduced.

In the inventive exhaust air dryer it is preferred if a heat exchanger is available, in which a heat exchange can take place between the supply air duct and the exhaust air duct. In this case the warm air from the drying chamber is used for heating the process air. In this connection, a heat exchange can preferably take place in the heat exchanger between the first and/or the second sub-duct and the exhaust air duct.

When a heat exchanger is used, the supply air duct and the exhaust air duct containing the warm air from the drying chamber, or the heat source of the heat pump, generally intersect.

A particularly preferred embodiment of the inventive exhaust air dryer is characterized in that a flow regulator, in particular a controllable flap or a controllable valve, is arranged in the supply air duct. Such a flow regulator in the inventive exhaust air dryer can be equipped in a variety of ways, so long as it can control the regulation of the flow of process air. The flow regulator is preferably a flap or a valve.

This flow regulator can regulate the airflow in a variety of ways. The type of regulation can depend on the arrangement and construction of the flow regulator. The flow regulator can thus regulate only one airflow through the supply air duct, in particular to such an extent that the contribution of the second flow path of the fan to the delivery rate is canceled out. If necessary, in interaction with a corresponding regulation of the heating, in particular the temperature level of the heated supply air can therefore be influenced, and in particular a more rapid heating of the items to be dried in the drying chamber can be achieved. Alternately or in addition to this, the flow regulator can simultaneously activate a second supply air inlet and thus in particular offer an enhanced control range. The flexible utilization of the waste heat of a motor present in the exhaust air dryer, or another component, via an infeed of supply air from the inner space, that is controllable by means of the flow regulator, makes it possible for a flow of process air through the exhaust air dryer to be increased only when a predetermined temperature is reached. In this connection the invention facilitates low-cost regulation of the process airflow through the exhaust air dryer.

Each configuration of the inventive exhaust air dryer has the advantage of being very energy efficient and, moreover, of facilitating rapid drying of laundry items. The latter therefore holds true because the invention allows an increase in the airflow through the exhaust air dryer. The increase in the airflow in turn allows an increase in the heating power to be applied, with which a further acceleration of the drying process is possible. Furthermore, it is certainly possible to implement additional measures for at least partial recovery of the heat energy expended in the drying process. In particular, the use of a cross-flow heat exchanger for a further increase in energy efficiency is possible.

BRIEF DESCRIPTION OF THE DRAWINGS

Exemplary embodiments of the invention are revealed in the following description with reference to the figures of the drawing, where a.

b.

c.

d.

DETAILED DESCRIPTION OF EXEMPLARY EMBODIMENTS OF THE PRESENT INVENTION

Figure 1:
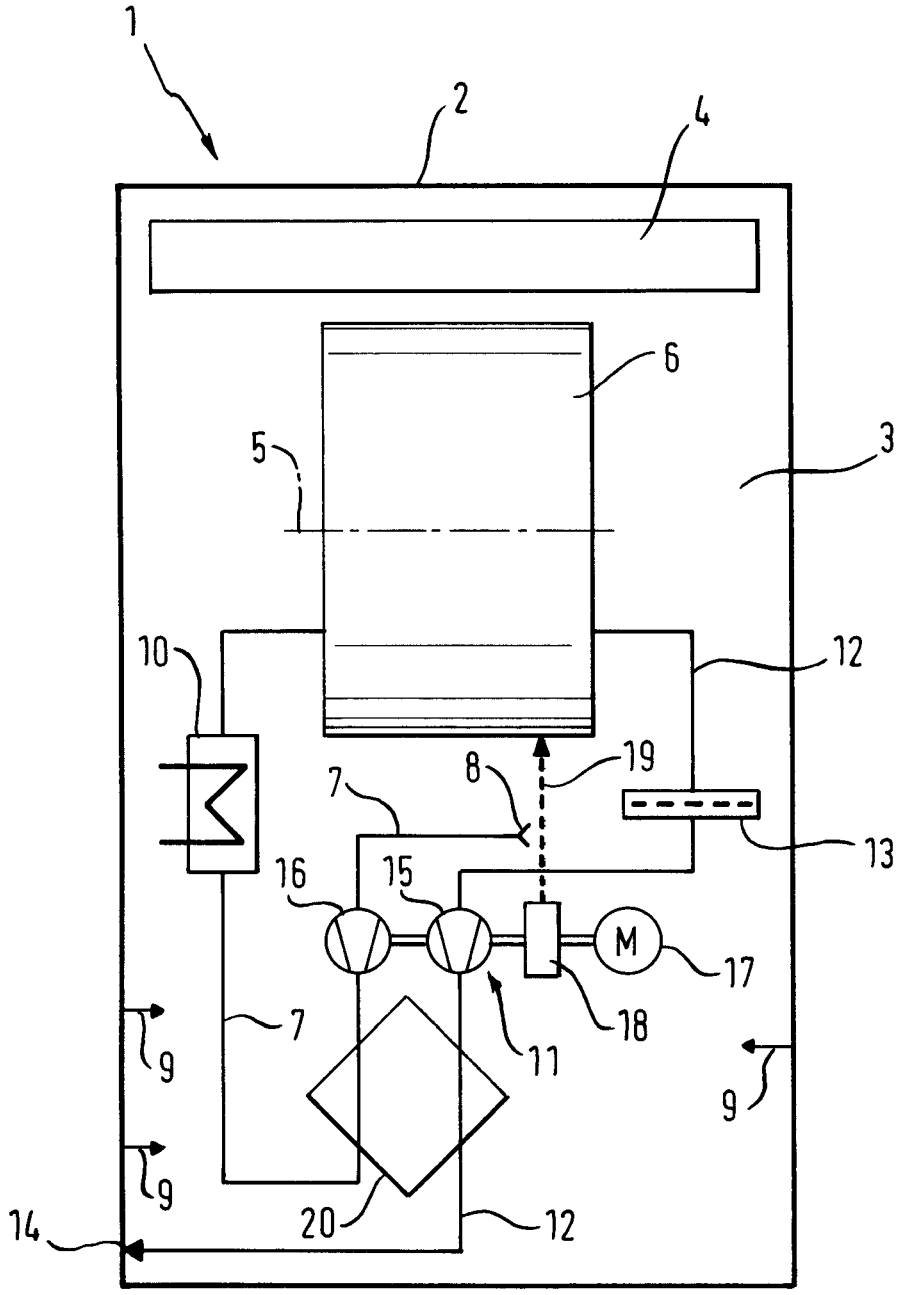
FIG. 1 shows an outline of an embodiment of an exhaust air dryer.

FIG. 1 shows in outline a vertical section through an exhaust air dryer 1. A housing 2 encloses an inner space 3 of the exhaust air dryer 1, in which inner space is arranged, among other things, a control device 4 which as well as receiving control commands from a user also provides operation and control of functional components of the exhaust air dryer, in particular those components which are referred to below. Means via which the user receives information from the control device 4, and issues appropriate control commands to the control device 4, are not shown for the sake of clarity. Also arranged in the housing 2 is a drying chamber or drum 6 rotatable about an axis 5, into which the damp items to the dried have to be placed. A supply air duct 7 is provided in which air is drawn in through a first supply air inlet 8 and fed to the drum 6 for drying the damp items. The first supply air inlet opens into the inner space 3 so that via the latter, air which was preheated by heat emitted by the functional components of the exhaust air dryer 1, can be drawn in. A housing 2 as shown here is usually not designed to be sealed against the surroundings of the exhaust air dryer 1; such a design would also in no way be necessary or useful for the function of the exhaust air dryer 1. Rather, in the housing there is a large number of slits or slots 9 which here are shown symbolically by arrows 9 and through which air from the surroundings of the exhaust air dryer 1 can reach inside the latter with little obstruction. A heater 10 which can be designed in the known manner as an electric heater 10 or gas heater 10 is arranged in the supply air duct 7, as well as a fan 11 for conveying the supply air.

After the drying chamber 6, the now moisture-laden air, now termed "exhaust air" reaches an exhaust air outlet 14 at the housing 2, via an exhaust air duct 12 and a lint filter 13 for collecting accompanying lint (here understood to mean small fibre particles which the airflow detaches from the items to be dried). In accordance with the usual practice and regulations, the exhaust air outlet 14 cannot simply be left open if the exhaust air dryer 1 is installed inside a building; rather, a hose or such like must be connected by which the moisture-laden air can be directly conveyed out of the building.

In the exhaust air dryer 1 described here the fan 11 is designed as a dual-flow fan 11, which means that it combines two sectional fans or flow paths 15 and 16 which are independent of each other. Of these two flow paths 15 and 16, a first flow path 15 is arranged in the exhaust air duct 12, a second flow path 16, however, being arranged in the supply air duct 6. In this way the two flow paths 15 and 16 operate in a series circuit and together convey the flow of supply air and exhaust air through the exhaust air dryer 1. This exhaust air dryer 1 therefore has the advantage of being very energy efficient and also facilitating faster drying of laundry items. The latter therefore holds true because the dual-flow fan 11 permits an increase in the airflow through the exhaust air dryer 1. The increase in the airflow in turn allows an increase in the heating power to be applied by the heater 8, by which a further acceleration in the drying process is possible. Moreover it is certainly possible to implement additional measures for at least partial recovery of the heat energy expended in the drying process, details of which are dealt with later on.

The two flow paths 15 and 16 of the fan 11 are driven by a motor 17 which also rotates the drum 6. This rotation is achieved via a pulley 18 connected to the motor 17 and an endless belt 19, here denoted by a broken arrow, wrapped around the drum 6 and the pulley 18.

The heat exchanger 20 is part of the supply air duct 7 and the exhaust air duct 12; it facilitates transmission of heat from the exhaust air to the supply air, corresponding to a recovery of heat energy which otherwise would be removed with the exhaust air out of the exhaust air dryer 1. It should be pointed out that as a consequence of the cooling of the exhaust air, moisture can condense out from this exhaust air. If necessary, precautions should be taken in order to collect and dispose of this condensed moisture; note should be taken of suitable measures on a condensing dryer of known construction, which are easily transferable to the exhaust air dryer 1 illustrated here.

Figure 2:
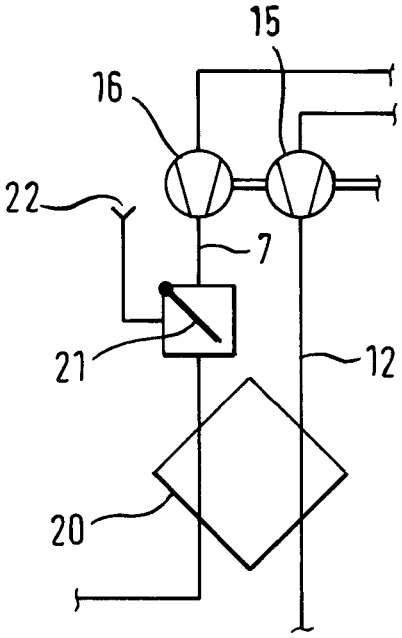
FIG. 2 shows an outline of another embodiment of an exhaust air dryer.

FIG. 2 shows parts of an embodiment of an exhaust air dryer 1, which is modified in relation to the embodiment of FIG. 1. The modification consists in that the supply air duct 7 is extended between the second flow path 16 and the heat exchanger 20 by a flow regulator 21 in the form of a moveable flap 21. The influence of the second flow path 16 on the supply air flowing in the supply air duct 7 can be completely or partially canceled by this flap 21. Consequently, regulation of the airflow is possible. In particular, by reducing the airflow, an increased temperature can be produced in the airflow after traversing the heater 8, which can be significant for the purpose of accelerated heating or even drying of the damp items in the drying chamber 6.

Currently the flow regulator 21 is designed so that to the extent it closes off the part of the supply air duct 7 with the second flow path 16, it opens a second supply air inlet 2. This ensures that, irrespective of the position of the flow regulator 21, a certain flow of supply air is always possible and overheating of the heater 8 is eliminated.

Figure 3:
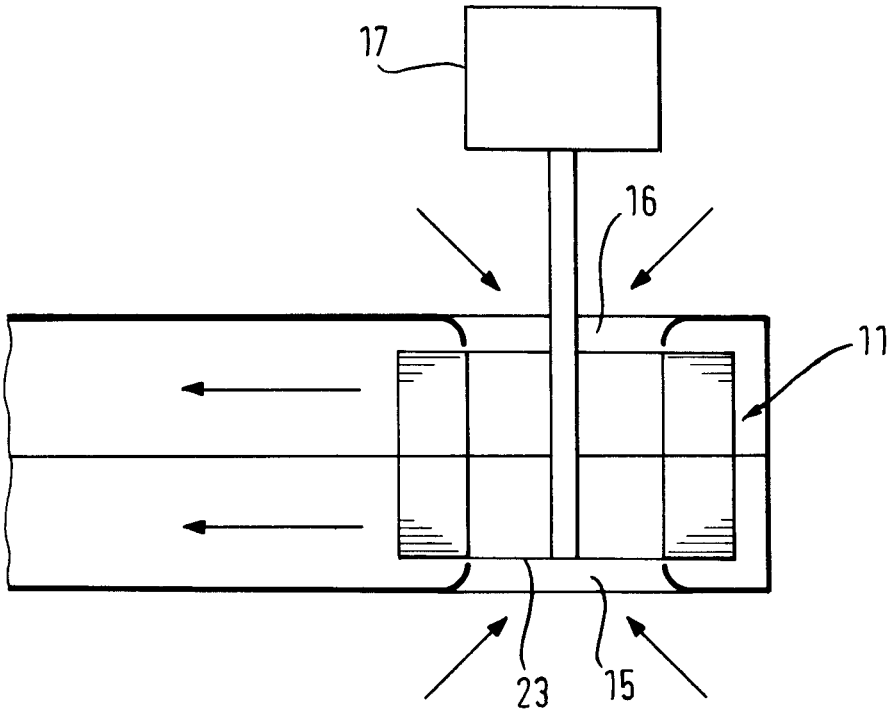
FIG. 3 shows an exemplary embodiment of a dual-flow fan.

FIG. 3 shows a dual-flow fan 11 designed as a radial fan 11 and driven by the motor 17. The flow paths 15 and 16 are sealed with respect to each other. A single impeller 23 is provided, it being possible for each flow path 15 or 16 to be directed to one half of this impeller 23.

Figure 4:
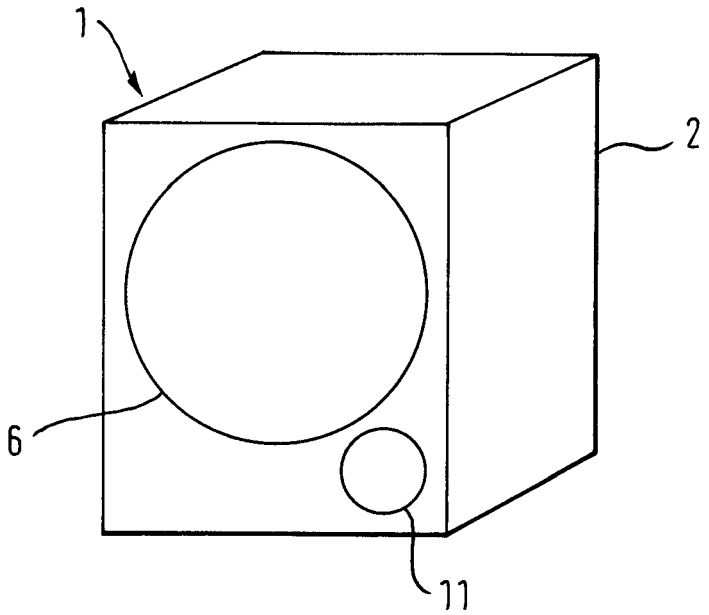
FIG. 4 shows an oblique view, and e.
Figure 5:
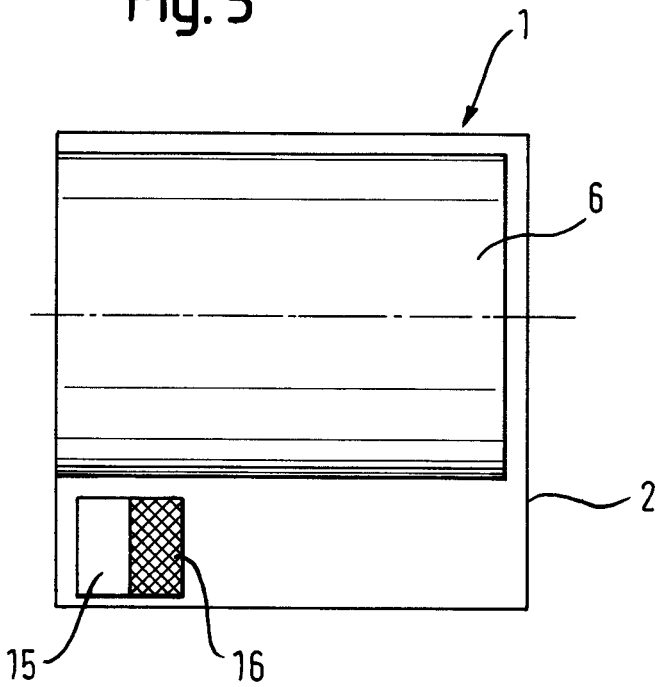
FIG. 5 shows a side view of a further embodiment of an exhaust air dryer.

FIGS. 4 and 5 show an oblique view and a side view of an exhaust air dryer 1 to clarify the geometrical relationships in which advantages are currently achieved by the use of a dual-flow fan 11. The component of the exhaust air dryer 1 making most use of the inner space 3 in the housing 2 is the drum 6 which, in the context of developing building space for further components cannot be made smaller. If a better fan effect is desired then the building space for an enlargement of the fan 11, which according to conventional practice is located obliquely underneath the drum 6, is also limited. This object is advantageously achieved with the introduction of the dual-flow fan 11 and provides an exhaust air dryer 1 having an improved flow rate of supply air and exhaust air.

LIST OF REFERENCE NUMBERS

1 Exhaust air dryer
2 Housing
3 Inner space
4 Control device
5 Axis
6 Drying chamber
7 Supply air duct
8 First supply air inlet
9 Slot in housing
10 Heater
11 Fan
12 Exhaust air duct
13 Lint filter
14 Exhaust air outlet
15 First flow path
16 Second flow path
17 Motor
18 Pulley
19 Belt
20 Heat exchanger
21 Flow regulator, flap
22 Second supply air inlet
23 Impeller

The invention claimed is:

1. An exhaust air dryer, comprising:
a housing enclosing an inner space;
a drying chamber for items to be dried, the drying chamber arranged in the inner space;
a supply air duct arranged in the inner space between a first supply air inlet and the drying chamber to provide supply air;
a heater to heat the supply air in the supply air duct, the heater arranged in the inner space;
a fan to guide heated supply air through the drying chamber, the fan arranged in the inner space;
an exhaust air duct arranged in the inner space between the drying chamber and an exhaust air outlet on the housing to exhaust air;
a second supply air inlet arranged in the supply air duct and into which a second flow of air is drawn in; and
a flow regulator arranged in the inner space and which regulates air flow through the supply air duct such that the second flow of air is opened when a first flow of air from the first supply air inlet is closed;
wherein the fan is a dual-flow fan having a first flow path and a second flow path; and
wherein the first flow path is arranged in the exhaust air duct and the second flow path is arranged in the supply air duct.

2. The exhaust air dryer of claim 1, further comprising a motor arranged in the housing, wherein the drying chamber is rotatable by the motor, and wherein the first supply air inlet is structured to draw in air from a vicinity of the motor.

3. The exhaust air dryer of claim 2, wherein the motor is operable to drive the drying chamber and the fan.

4. The exhaust air dryer of claim 1, wherein each of the first flow path and the second flow path has a throughput of 50 $m^3/h$ to 500 $m^3/h$.

5. The exhaust air dryer of claim 1, wherein the heater contains one of a gas heater and an electric heater.

6. The exhaust air dryer of claim 1, further comprising a heat exchanger in which a heat exchange takes place between the supply air duct and the exhaust air duct.

7. The exhaust air dryer of claim 1, wherein the flow regulator is arranged between the second flow path and the heater.

8. The exhaust air dryer of claim 1, wherein the flow regulator is a flap.

9. The exhaust air dryer of claim 1, wherein the flow regulator regulates air flow through the supply air duct such that the second flow of air is closed when the first flow of air from the first supply air inlet is opened.

10. The exhaust air dryer of claim 1, wherein the flow regulator regulates air flow through the supply air duct so as to permit a combined flow of the second flow of air and the first flow of air through the exhaust air duct.

11. An exhaust air dryer, comprising:
a supply air duct through process air is conveyed;
a first supply air inlet into which a first flow of process air is drawn into the supply air duct;
a second supply air inlet into which a second flow of process air is drawn into the supply air duct;
a heater arranged which heats the process air in the supply air duct;
an exhaust air duct through which exhaust air is conveyed through an exhaust air outlet;

a dual flow fan having a first flow path arranged in the exhaust air duct and a second flow path arranged in the supply air duct;

a heat exchanger which permits heat exchange between the supply air duct and the exhaust air duct; and a flow regulator arranged in the inner space and which regulates the first flow of process air from the first supply air inlet and the second flow of process air from the second supply air inlet such that the second flow of process air from the second supply air inlet is opened when the first flow of process air from the first supply air inlet is closed.

12. The exhaust air dryer of claim 11, wherein the flow regulator regulates the first flow of process air from the first supply air inlet and the second flow of process air from the second supply air inlet such that the second flow of process air from the second supply air inlet is closed when the first flow of process air from the first supply air inlet is opened.

13. The exhaust air dryer of claim 11, wherein the flow regulator regulates the first flow of process air from the first supply air inlet and the second flow of process air from the second supply air inlet so as to permit a combined flow of the second flow of process air and the first flow of process air through the supply air duct.

14. The exhaust air dryer of claim 11, wherein:

the first supply air inlet is arranged upstream of the dual flow fan; and the second supply air inlet is arranged down stream of the dual flow fan.

15. The exhaust air dryer of claim 11, wherein the flow regulator is arranged between the second flow path and the heater.

16. An exhaust air dryer, comprising:

a drying chamber for items to be dried;

a first supply air inlet into which a first flow of process air is drawn into the exhaust air dryer;

a second supply air inlet into which a second flow of process air is drawn into the exhaust air dryer;

a supply air duct into which the first flow of process air and the second flow of process air is fed to the drying chamber;

a heater arranged in the supply air duct to heat the process air in the supply air duct;

an exhaust air duct arranged through which exhaust air from the drying chamber flows and is conveyed through an exhaust air outlet;

a dual flow fan having a first flow path arranged in the exhaust air duct and a second flow path arranged in the supply air duct;

a heat exchanger arranged in the exhaust air duct and the supply air duct to permit heat exchange between the supply air duct and the exhaust air duct; and a flow regulator arranged in the inner space and which regulates the first flow of process from the first supply air inlet and the second flow of process air from the first supply air inlet such that the second flow of process air from the second supply air inlet is opened when the first flow of process air from the first supply air inlet is closed.

17. The exhaust air dryer of claim 16, wherein the flow regulator regulates the first flow of process air from the first supply air inlet and the second flow of process air from the second supply air inlet such that the second flow of process air from the second supply air inlet is closed when the first flow of process air from the first supply air inlet is opened.

18. The exhaust air dryer of claim 16, wherein the flow regulator regulates the first flow of process air from the first supply air inlet and the second flow of process air from the second supply air inlet so as to permit a combined flow of the second flow of process air and the first flow of process air through the supply air duct.

19. The exhaust air dryer of claim 16, wherein:

the first supply air inlet is arranged upstream of the dual flow fan; and the second supply air inlet is arranged down stream of the dual flow fan.

20. The exhaust air dryer of claim 16, further comprising a motor which drives the dual flow fan and rotates the drying chamber, wherein the first supply air inlet is positioned such that the first airflow flows over the motor.

* * * * *